US006358113B1

(12) United States Patent
Ruggiero

(10) Patent No.: US 6,358,113 B1
(45) Date of Patent: Mar. 19, 2002

(54) DOLL NURSERY

(75) Inventor: James A. Ruggiero, Twinsburg, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 09/632,839

(22) Filed: Aug. 4, 2000

(51) Int. Cl.[7] ..... A63H 3/52
(52) U.S. Cl. ..... 446/482; 446/227; 446/479
(58) Field of Search ..... 446/227, 268, 446/296, 476, 477, 478, 479, 482, 404, 175; 297/217.3; 472/101, 97, 96, 95; 5/101, 108, 109

(56) References Cited

U.S. PATENT DOCUMENTS

| | | | | |
|---|---|---|---|---|
| 3,577,675 A | * | 5/1971 | Kohner | 446/227 |
| 3,713,652 A | * | 1/1973 | Rakestraw | 446/482 |
| 4,095,843 A | | 6/1978 | Hirsch | |
| 4,139,967 A | * | 2/1979 | Kuna et al. | 446/476 |
| 4,161,081 A | * | 7/1979 | Katzman | 446/476 |
| 4,627,588 A | | 12/1986 | Block | |
| 4,697,845 A | | 10/1987 | Kamman | |
| 4,799,915 A | * | 1/1989 | Lehmann et al. | 446/279 |
| 4,854,913 A | * | 8/1989 | Kelley et al. | 446/482 |
| 5,125,866 A | | 6/1992 | Arad et al. | |
| 5,238,291 A | | 8/1993 | Alionis | |
| 5,413,399 A | | 5/1995 | Myers et al. | |
| 5,495,151 A | | 2/1996 | Lu | |
| 5,584,531 A | | 12/1996 | Bowman | |
| 5,732,999 A | | 3/1998 | Petrie | |
| 5,791,999 A | | 8/1998 | Lauro et al. | |
| 5,803,817 A | | 9/1998 | Stern | |

* cited by examiner

*Primary Examiner*—Jacob K. Ackun, Jr.
*Assistant Examiner*—Faye Francis
(74) *Attorney, Agent, or Firm*—Foley & Lardner

(57) ABSTRACT

A nursery includes a frame, a bassinet, a swing, a single drive unit and a coupling mechanism. The bassinet, the swing, the drive unit and the coupling assembly are supported by the frame. The coupling assembly is operably coupled to the drive unit and has first and second outputs. The first output is pivotally coupled to the bassinet and the second output is pivotally coupled to the swing. The coupling assembly is configured to transfer the drive unit output to one of the swing and the bassinet such that the one of the swing and the bassinet swing relative to the frame. An apparatus for selectably operating at least two separate features of a toy includes a frame, first and second devices coupled to the frame, a control device, a single drive unit, and a gear assembly. The gear assembly includes a pivoting member, and first and second output assemblies. The pivoting member is positionable between a first position, in which a second end of the pivoting member operably connects to the first output assembly, and a second position, in which the second end of the pivoting member operably connects to the second output assembly. A relocatable transmitter actuation device is removably connected to the frame. The actuation device is configured to operate in response to the position of a plurality of switches and to generate a plurality of signals for controlling a sound transducer and at least one of the first and second movable devices.

26 Claims, 12 Drawing Sheets

7
22
84
82
70
86
94
88
74
76
90
92
78
80
104
100
4
24
66
98
114
108
110
102
106
112
4

84
82
70
86
22
66
76
80
74
78
24
114
102
98
104
100

DOLL NURSERY

FIELD OF THE INVENTION

The present invention relates generally to the field of toy activity centers. More particularly, the invention relates to a doll nursery center.

BACKGROUND OF THE INVENTION

Children enjoy playing with stuffed animals, dolls and figurines. Boys and girls alike often spend significant amounts of time playing with stuffed animals, dolls and figurines, and mimicking various human activities including eating, sleeping and playing. Children also enjoy role playing and, in particular, playing the role of a parent where the child pretends that the doll, stuffed animal or figurine is its baby. In many instances, a child will: prop a doll into a chair in order to pretend to feed the doll; lay a doll down in a make shift cradle and pretend to rock the doll to sleep; or place the doll in a swing or rocking chair and swing the doll. Children also enjoy singing lullabies or playing music to their dolls.

There are many known individual high chairs, individual bassinets and individual swings that are particularly adapted to accommodate a child's doll, stuffed animal or figurine and to facilitate the child's role playing. Such high chairs are supplied in numerous and varied shapes and sizes. Such bassinets and swings are typically manually operated and are distinctly separate devices.

Existing toy high chairs, toy bassinets and toy swings have a number of drawbacks. Each of these devices are typically designed as separate items requiring a parent or guardian who is seeking to obtain these toys for a child, to obtain three separate products. For many parents, purchasing three separate toys can be prohibitively expensive or burdensome. Further, each of these toys occupies a large amount of space and, for many households attempting to store three large toys of this type is very difficult. Additionally, because the toy high chairs, toy bassinets and toy swings are designed as inherently separate items, the probability of one or more of these toys becoming misplaced is very high in many households. Toy bassinets or toy swings typically are manually operated and require the child to repeatedly manipulate the bassinet or swing in order to achieve the desired rocking motion. Toy high chairs, bassinets or toy swings typically do not produce sounds, such as music.

Thus, there is a need for a doll nursery center that conveniently combines the features of a toy high chair, toy bassinet and a toy swing in a single toy, thus eliminating the need to purchase and store three separate toys. It would be advantageous to provide a single toy which includes the features of these three separate toys, takes up less storage space than the three individual toys collectively, and is less expensive to purchase than the three separate toys. What is needed, in part, is a toy bassinet and a toy swing which is configured to automatically rock or swing a child's doll, stuffed animal or figurine. It would be advantageous to provide a toy high chair, toy bassinet and a toy swing which is capable of producing sounds such as lullabies or baby sounds. It further would be advantageous to provide a doll nursery center which is fun, safe and easy to use for children.

SUMMARY OF THE INVENTION

According to a principal aspect of the invention, a nursery includes a frame, a bassinet, a swing, a single drive unit and a coupling mechanism. The bassinet and the swing are supported by the frame. The drive unit is connected to the frame. The coupling assembly is operably coupled to the drive unit and has first and second outputs. The first output is pivotally coupled to the bassinet and the second output is pivotally coupled to the swing The coupling assembly is configured to transfer the drive unit output to one of the swing and the bassinet such that the either the swing or the bassinet swing relative to the frame.

According to anther aspect of the invention, an apparatus is provided for selectably operating at least two separate features of a toy. The apparatus includes a frame, first and second devices coupled to the frame, a control device, a single drive unit, and a gear assembly. The single drive unit is coupled to the frame and is operably coupled to the control device. The drive unit has a drive shaft configured to produce a first output movement and a second output movement in response to first and second control signals, respectively, from the control device. The gear assembly is coupled to the frame, and the gear assembly includes a pivoting member and first and second output assemblies. The pivoting member is operably coupled at a first end to the drive shaft. The pivoting member is positionable between two positions. In a first position, a second end of the pivoting member operably connects to the first output assembly in response to the first output movement of the drive shaft. In a second position, the second end of the pivoting member operably connects to the second output assembly in response to the second output movement of the drive shaft. The first and second output assemblies are operably coupled to the first and second devices, respectively.

According to anther aspect of the invention, an electronic play center includes a frame, first and second movable devices, a drive mechanism, and a relocatable transmitter actuation device. The frame has at least one actuator receiving port. The first and second movable devices are supported by the frame. The drive mechanism is Coupled to the frame and to the first and second movable devices. The relocatable transmitter actuation device is removably connected to the frame. The actuation device includes a sound transducer, a circuit and a plurality of switches. The sound transducer is connected to the actuation device and is configured to produce sounds. A plurality of switches are coupled to the actuation device and a circuit is connected to the actuation device. The circuit is electrically coupled to the sound transducer and to the plurality of switches. The circuit is configured to operate in response to the position of the plurality of switches and to generate a plurality of signals for controlling the sound transducer and at least one of the first and second movable devices.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
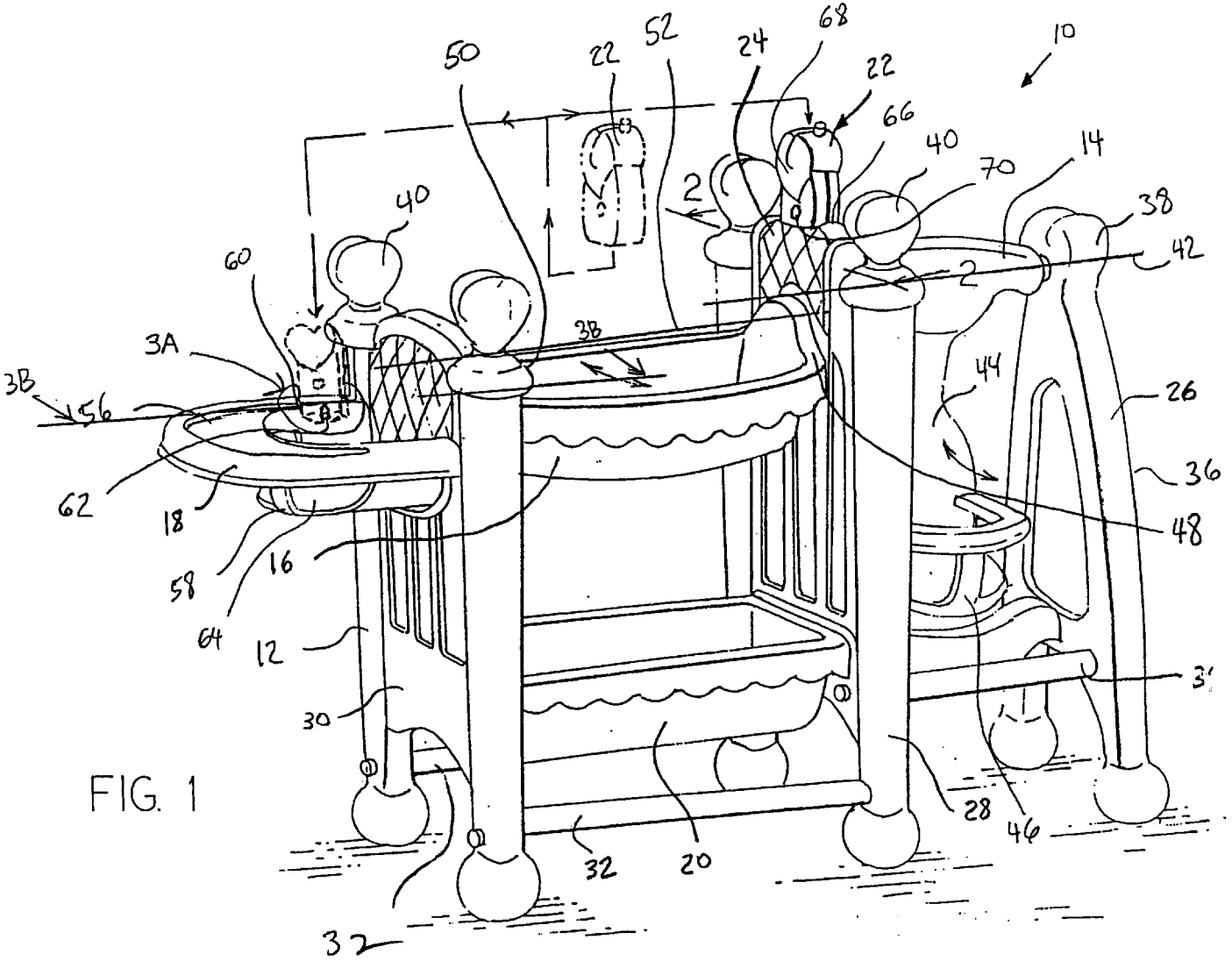
FIG. 1 is a front perspective view of a doll nursery in accordance with the present invention.

Referring to FIG. 1, a front perspective view of a doll nursery constructed in accordance with a preferred embodiment of the present invention is shown generally at 10. The doll nursery 10 generally includes a frame 12, a swing 14, a bassinet 16, a seat member 18, a storage bin 20, a relocatable transmitter actuation device 22 and a drive assembly 24. The frame 12 is a support structure configured to support the swing 14, the bassinet 16, the seat member 18, the storage bin 20, the actuation device 22 and the drive assembly 24. The frame 12 is generally made of molded plastic, but alternatively can be made of other materials such as wood, fiberglass and aluminum. The frame 12 is configured to facilitate access to the components of the nursery 10. The frame 12 efficiently minimizes the amount of space occupied by the swing 14, the bassinet 16, and the seat member 18, thereby enabling the nursery 10 to be easily transported and stored.

The frame 10 includes three upstanding support sections 26, 28, 30, a pair of bassinet horizontal cross members 32 and a pair of swing horizontal cross members 34 (only one of the two are shown). The support section 26 is a triangular type structure. The support section 26 is pivotally coupled to swing 14 and connected to the pair of swing horizontal cross members 34. The support section 26 pivotally is supports the swing 14 in an elevated position. The support section 26 includes an upstanding outer surface 36 and a top portion 38. In a preferred embodiment, the outer surface 36 includes a molded pattern, such as a teddy bear, and the top portion 38 has a bulbous heart shape.

The support section 28 is the main support component of the frame 12. The support section 28 is generally centrally positioned between and pivotally coupled to the swing 14 and the bassinet 16. The support section 28 is connected to support the bin 20, the drive assembly 24 and the pair of horizontal bassinet cross members 32. The support section 28 supports the swing 14, the bassinet 16 and the bin 20 in an elevated position, and enables the drive assembly 24 to be optimally positioned at the pivot axes of the swing 14 and the bassinet 16. In a preferred embodiment, the support section 28 is formed in the shape of a conventional crib side wall and includes a bulbous heart 40 attached to each upper corners of the support section 28. Other ornamental shapes are contemplated, such as stars, bears, moons and other conventional shapes.

The support section 30 is a rectangular shaped support section advantageously connected to seat member 18 to form an outwardly extending high chair. The support section 30 is pivotally coupled to the bassinet 16, and is connected to the bin 20 and the pair of horizontal bassinet cross-members 32. The support section 30 is configured to support the seat member 18, the bassinet 16 and the bin 20 in elevated positions. The support section 30 is preferably formed in the shape of a conventional crib side wall and has a molded pattern resembling a seat backing formed into the upper, outer surface of the support section 30. The support section 30 also includes the bulbous heart 40 attached to each upper corners of the support section 30. Other ornamental shapes are contemplated, such as stars, bears, moons and other well known shapes.

The horizontal cross-member 32, 34 is an elongate tube having a rod (not shown) extending therethrough. The bassinet cross-members 32 are connected to the support members 28, 30 and the swing cross-members 34 are connected to the support members 26, 28. The cross-members 32, 34 provide increased strength and stability to frame 12. The rod of the cross-member 32, 34 is preferably made of metal and the tube of the cross-member 32, 34 is preferably made of plastic.

The swing 14 is a seat member pivotally coupled to the support members 26 and the drive assembly 24. The swing 14 is configured to support a doll (not shown) or other toy such as a stuffed animal, figurine, etc. The swing 14 is configured automatically to swing or pivot in an arcuate motion about a first pivot the axis 42 in response to the pivotal movement of the drive assembly 24. The swing 14 is preferably made of molded plastic, but alternatively the swing 14 can be made of other materials, such as wood, fiberglass and aluminum. In a preferred embodiment, the swing 14 is made of a seat back portion 44 connected to a forward seat portion 46. In an alternative embodiment, the swing 14 is formed in one piece.

The bassinet 16 is an elongate cradle having first and second ends 48, 50. The bassinet 16 is connected to the drive assembly 24 at first end 48 and is pivotally coupled to the support section 30 at second end 50. The bassinet 16 is configured to support a doll, a stuffed animal or a figurine (not shown) in a generally prostrate position. The bassinet 16 is also configured to rock or pivot about a longitudinal axis 52 of the bassinet 16 in response to an output of the drive assembly 24. The bassinet 16 is made of molded plastic, but alternatively, bassinet 16 can be made of other materials, such as wood, fiberglass and aluminum.

The seat member 18 is a support structure connected to an outer surface of the support section 30 to advantageously form a high chair. The seat member 18 includes a generally planar tray portion 56 coupled to the curved seat portion 58. The tray portion 56 substantially wraps around the seat portion 58 and has a generally horizontal upper surface for supporting eating utensils, dishes, and imaginary, toy or even real food stuffs. The tray portion 56 has a high chair actuator receiving port 60 defined into the tray portion 56 and a tang 62 upwardly projecting from the tray portion 56 into receiving the port 60. The curved seat portion 58 includes two leg openings 64 for receiving a leg, or other appendage, of a doll, stuffed animal or figurine. The seat member 18 is configured to support a doll, stuffed animal or figurine in a generally seated position to facilitate the feeding of a doll, or the like, with imaginary, toy or real food stuffs. The seat member 18 is made of molded plastic. Alternatively, the seat member 18 can be made of other materials, such as wood, fiberglass and aluminum. In one embodiment, the tray portion 56 includes a molded depression in the shape of a spoon.

The bin 20 is a rectangular container with an open top and is connected between the support members 28, 30 and disposed substantially beneath the bassinet 16. The bin 20 is also configured to hold toys, real or toy clothes, blankets and miscellaneous real or toy baby supplies. The bin 20 is also configured to resemble a conventional shelving or storage area commonly found on bassinet assemblies. The bin 20 is made of molded plastic but alternatively, the bin 20 can be made of other materials, such as wood and aluminum.

Relocatable transmitter actuation device 22 is a portable control unit and also a sound generating device having a front cover 68 and a pushbutton 70 mounted onto front cover 68. The actuation device 22 is a generally rectangular structure which resembles a conventional baby monitor. In a preferred embodiment, a top portion of the actuation device has an outer heart shape. Other ornamental shapes are contemplated, such as stars, bears and moons. The actuation device 22 is removably insertable into a receiving port 66 of the drive assembly 24, high chair receiving the port 60, or other similar port. The actuation device 22 is also configured for upright placement on any generally horizontal surface. The actuation device 22 is operative to actuate swing 14 and generate sounds when installed within receiving the port 66 with the front surface 68 preferably positioned toward the swing 14. When positioned in receiving the port 66 with the front surface 68 facing the bassinet 16, the actuation device 22 is configured to actuate the bassinet 16 and to generate sounds. When inserted into high chair receiving the port 60, the actuation device 22 is configured to generate sounds. The pushbutton 70 enables a child or other user to re-activate the swing 14 or the bassinet 16, depending on the location of the actuation device and to re-generate sounds from the actuation device 22. The outer body of actuation device is preferably made of molded plastic. Other materials for the outer body of the actuation device 22, such as aluminum can also be used. The actuation device 22 enhances a child's role playing experience by replicating actual motions of a real swing or a real bassinet. The actuation device 22 further enhances a child's play by providing an interactive device for producing sounds including music and baby sounds. The actuation device 22 further provides an additional toy, a simulated baby monitor, which a child can use to incorporate into and enhance the child's role playing. The actuation device 22 is intended for easy and safe operation by small children.

The drive assembly 24 has a generally rectangular shape and is connected to an upper end of the support section 28. The drive assembly 24 is operably connected to the swing 14 and the bassinet 16. The drive assembly 24 defines receiving the port 66 for removably connecting to the actuation device 22. When connected to actuation device, the drive assembly 24 is configured to actuate a plurality of switches within the actuation device 22, receive a power signal from the actuation device 22 and convert the signal into motive force for swinging or pivoting the swing 14, or rocking or pivoting the bassinet 16. The outer cover of drive assembly 24 is made of molded plastic. Alternative materials for the outer cover of drive assembly are contemplated. In another form of the invention, a quilt pattern is molded the outer cover of the drive assembly 24.

Figure 2:
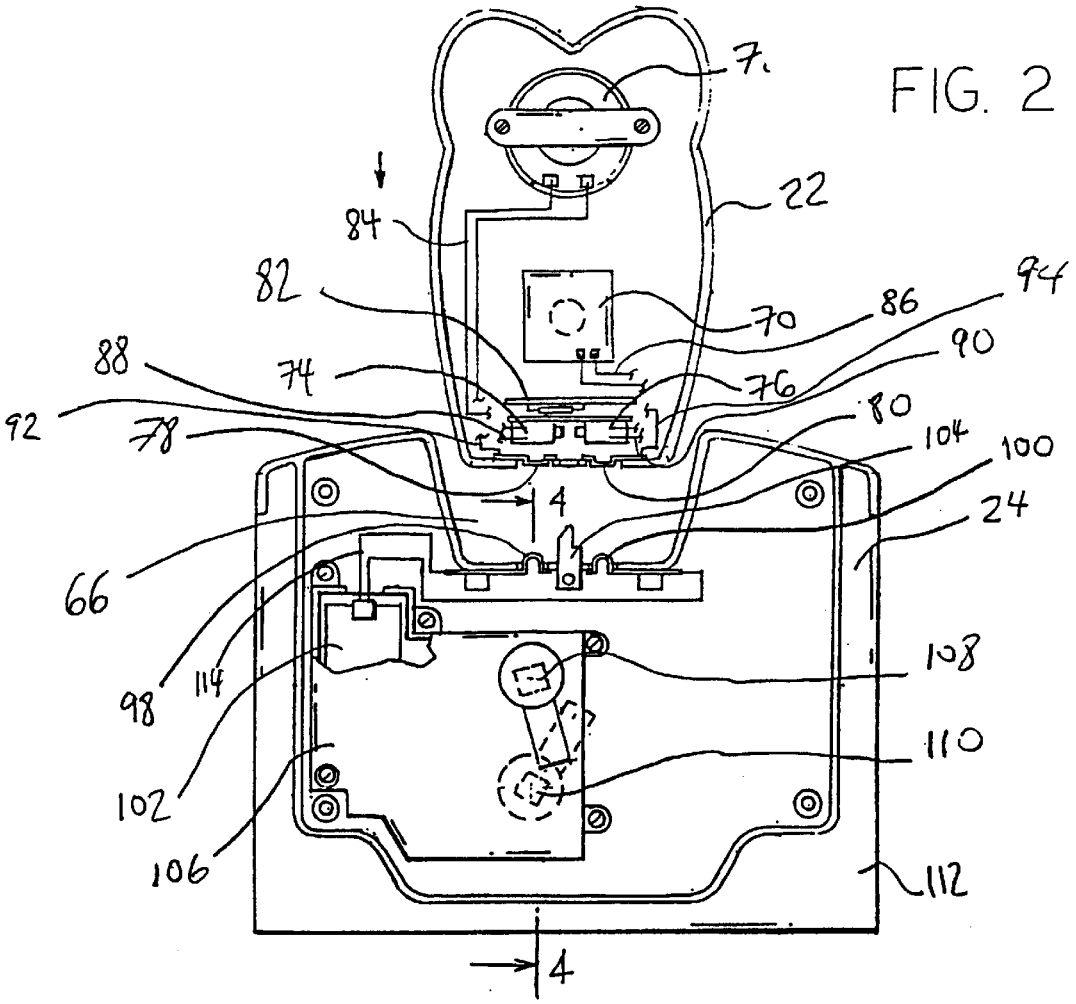
FIG. 2 is a cross-sectional view having a relocatable transmitter actuation device and a drive assembly taken substantially along line 2—2 of FIG. 1.

FIG. 2 illustrates the actuation device 22 and the drive assembly 24 in greater detail. The actuation device 22 further includes a sound transducer 72, a pushbutton 70, a first and second switches 74, 76, a first and second motor contacts 78, 80, and a printed circuit board ("PCB") 82. The sound transducer 72, also referred to as a speaker, is a sound generating device. The sound transducer 72 is mounted to the upper, inside surface of the front cover 68 of the actuation device 22 and is electrically coupled by a first wire connection 84 to the PCB 82. The sound transducer 72 generates sounds in response to signals from the PCB 82. The sounds generated by the sound transducer 72 can include music, baby related sounds and other soothing sounds. In a preferred embodiment, the sound transducer 72 is an eight ohm, 0.15 Watt, 36 millimeter diameter, Mylar speaker. The sound transducer 72 can also be of alternate size, power, resistance and manufacturer.

In order to enable manual activation of the actuation device 22, the push button 70 is provided. The pushbutton 70 is a conventional pushbutton contact device. A portion of pushbutton 70 forwardly extends through an opening defined within the front cover 68. The pushbutton 70 is mounted to the inside surface of the front cover 68 and electrically coupled by a second wire connection 86 to the PCB 82. When the actuation device 22 is positioned within a receiving port 60, 66, the pushbutton 70 is a switch, which when depressed by a child, or other user, sends a voltage signal to the PCB 82 resulting in a sound or a series of sounds being generated from the actuation device 22. The pushbutton 70 enables a child to participate in interactive play with the nursery 10. In a preferred embodiment, pushbutton is part of a conventional printed circuit board (designated as PT1072K1).

Figure 3A:
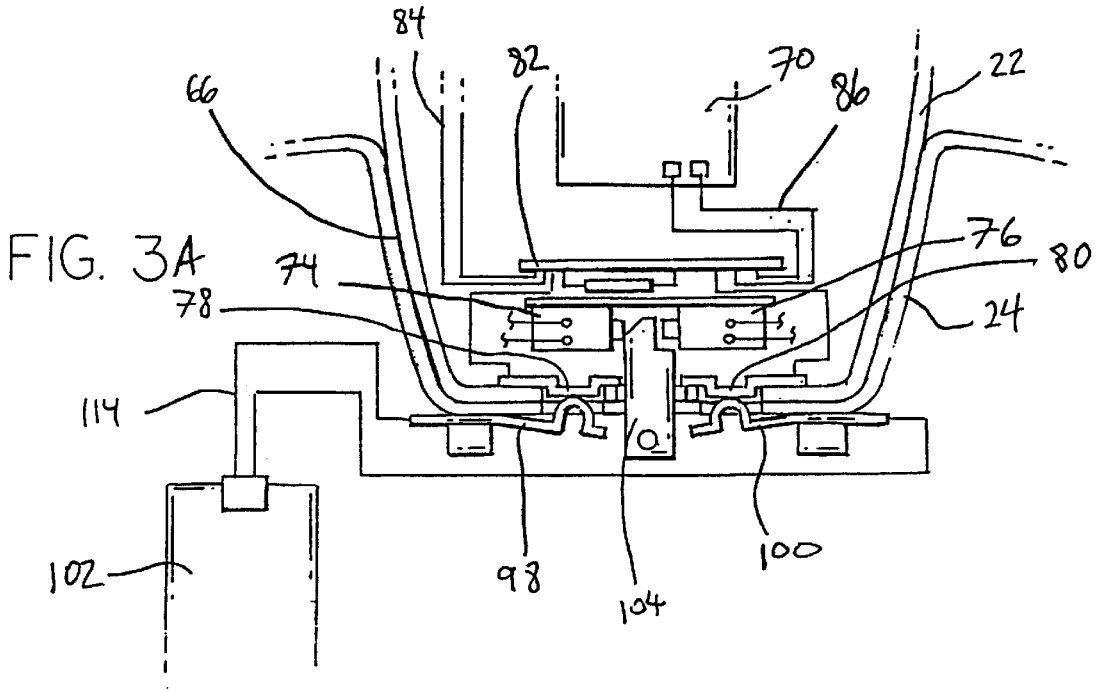
FIG. 3A is a sectional view of the connection of the actuation device of FIG. 2 mounted to a receiving port of the drive assembly taken substantially along line 2—2 of FIG. 1.
Figure 3B:
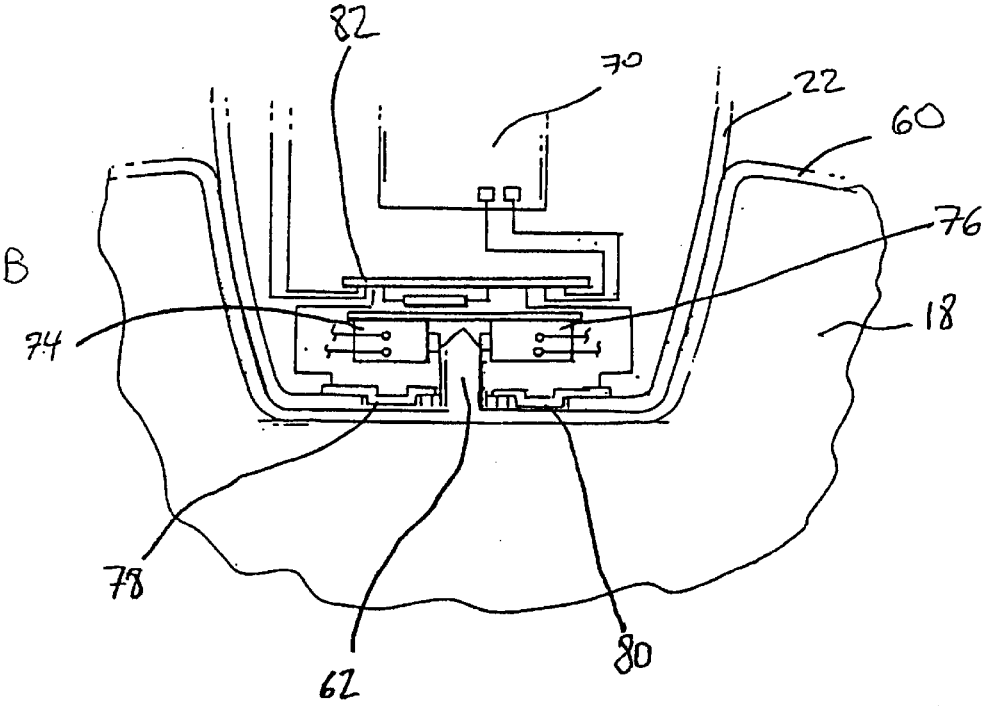
FIG. 3B is a sectional view of the connection of the actuation device of FIG. 2 to a receiving port of a seat member of the doll nursery taken substantially along line 3B—3B of FIG. 1.

The first and second switches 74, 76 are conventional switches coupled to the front cover 68 of the actuation device 22 and electrically coupled by the third and fourth wire connections 88, 90, respectively, to the PCB 82. As shown in FIG. 3, when the actuation device 22 is positioned within the receiving port 66 facing the bassinet 16, the first switch 74 is actuated enabling a voltage signal to be sent to the PCB 82. When actuation device is positioned within receiving port 66, facing swing 14, second switch 76 is actuated sending a separate voltage signal to the PCB 82. As shown in FIG. 3A, when actuation device is positioned within receiving the port 60 of the seat member 18, the tang 62 actuates the first and second switches 74, 76 sending voltage signals to the PCB 82.

Referring to FIGS. 2 and 3A, the first and second motor contacts 78 and 80 are conductive surfaces connected to the bottom surface of the actuation device 22. The first and second contacts 78, 80 are electrically coupled by the fifth and sixth wiring connections 92, 94, respectively to the PCB 82. When positioned within the receiving port 66, the first and second contacts 78, 80 of the actuation device 22 engage the corresponding first and second contacts 98, 100 of the drive assembly 24 completing a circuit with the drive assembly 24 and causing a motor 102 of the drive assembly 24 to operate.

The PCB 82 is a printed circuit board connected to the front cover 68 of the actuation device 22. The PCB 82 is electrically coupled to the pushbutton 70, the sound transducer 72, the first and second switches 74, 76 and the first and second contacts 78, 80. In a preferred embodiment, the PCB 82 is designated as PT1072A3.

Referring to FIG. 2, the drive assembly 24 includes an outer housing formed by the connection of a bassinet side housing portion 112 and a swing side housing portion 113 (see FIG. 4), are further including the first and second contacts 98, 100, the motor 102, the drive assembly tang 104, and the gear assembly housing 106 shown in FIG. 2. In a preferred embodiment, the first and second contacts 98, 100 of the drive assembly 24 are curved strips of conductive material, preferably a soft metal, such as, for example, aluminum. The first and second contacts 98, 100 are positioned on the housing portion 112 and connected between the housing portion 112 and the swing side housing portion 113. The first and second contacts 98, 100 are electrically coupled to the motor 102 by the seventh wire connection 114. As shown in FIG. 3, when the actuation device 22 is positioned within receiving the port 66 and facing the bassinet 16, the first contact 98 of the drive assembly 24 engages the first contact 78 of the actuation device 22 and the second contact 100 engages the second contact 80 enabling current flow between the power source of actuation device (not shown) and the motor 102 under a first polarity. When the actuation device 22 is positioned within receiving the port 66 and facing the swing 14, the first contact 98 of the drive assembly 24 engages the second contact 80 of the actuation device 22 and the second contact 100 engages the first contact 78 enabling current flow between the power source of the actuation device 22 to the motor 102 under a second polarity, reversed from the first polarity. Current flow under the first polarity causes the motor 102 to rotate in a first direction and current flow under the second opposite polarity causes motor to rotate in a second direction, opposite the first direction.

The motor 102 is coupled to the drive assembly 24 and electrically coupled to the first and second contacts 98, 100 by the seventh wire connection 114. The motor 102 provides the motive force to operate the swing 14 or the bassinet 16. In a preferred embodiment, the motor 102 is a dc motor manufactured by Mabuchi Motor and is designated by part number RC280SA (20120-DV).

The drive assembly tang 104 is an elongate projection connected to the housing portion 112 of the drive assembly 24 and upwardly projecting from the drive assembly 24 into receiving the port 66. The drive assembly tang 104 is configured to engage the first contact 74 of the actuation device 22 when the actuation device 22 is inserted within receiving the port 66 facing the bassinet 16 and is configured to engage the second contact 76 when the actuation device 22 is inserted within receiving the port 66 facing the swing 14.

The gear assembly housing 106 is a protective cover which is connected to the housing portion 112 of the drive assembly 24. The gear assembly housing 106 encloses the motor 102 and a gear assembly 118 (shown in FIGS. 6 and 7). The housing 106 includes an opening on each side. One opening is for a swing output shaft 108 of the gear assembly 118 and the second opening is for a bassinet output shaft 110 of the gear assembly 118.

Figure 4:
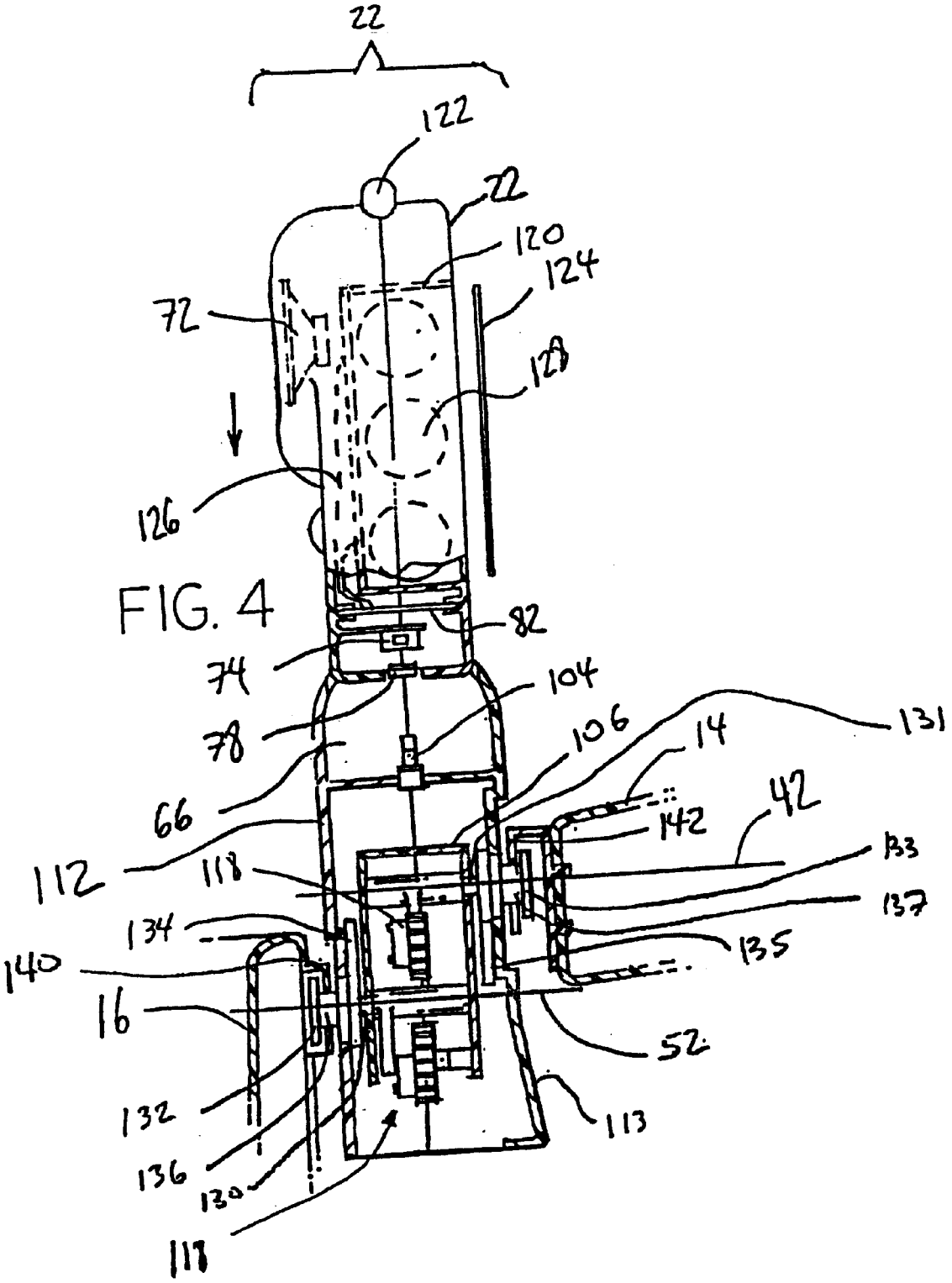
FIG. 4 is a cross-sectional view of the actuation device and the drive assembly taken substantially along line 4—4 of FIG. 2.

FIG. 4 illustrates the actuation device 22 in greater detail. The actuation device 22 further includes a battery case 120 and a mock antenna 122. The battery case 120 is formed into the rear portion of the actuation device 22 and includes a removable battery case cover 124. The battery case 120 is electrically coupled to the PCB 82 by an eighth wire connection 126. The battery case 120 is configured to hold a set of the batteries 128. In a most preferred embodiment, the batteries 128 comprise three, 1.5 Volt, "C" size batteries to produce a 4.5 Volt power supply for actuation device. The batteries 128 provide electrical power to operate the actuation device 22, the drive assembly 24, the swing 14 and the bassinet 16. Alternative power supplies and battery sizes can be utilized.

Figure 5:
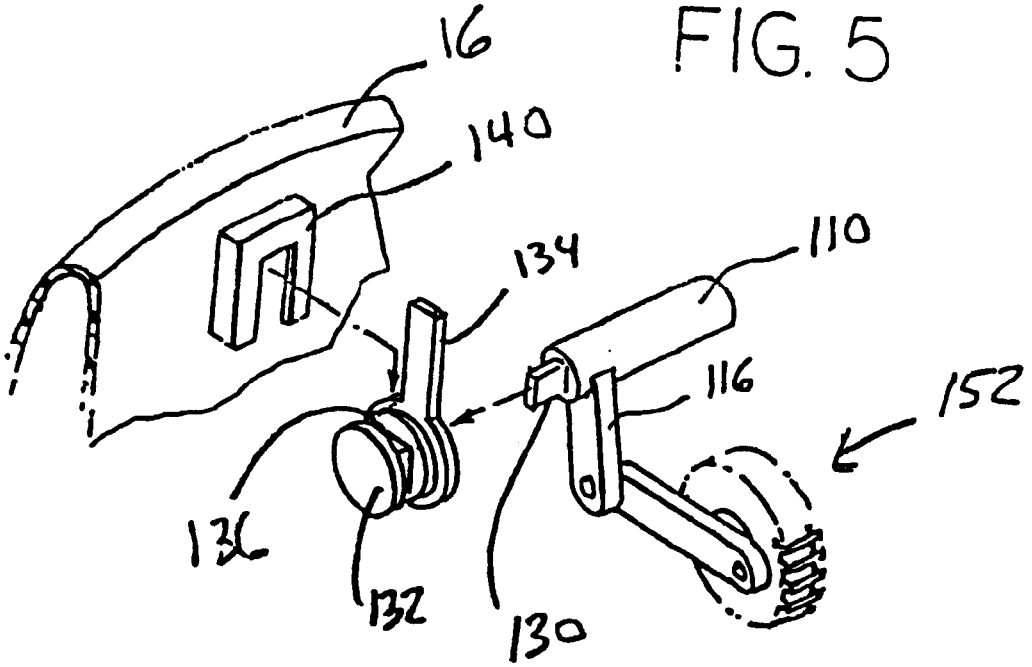
FIG. 5 is an exploded sectional view of the connection of the bassinet to the drive assembly including a gear assembly, a bassinet output shaft and a bassinet of the nursery of FIG. 1.

FIGS. 4 and 5 illustrate the coupling of the drive assembly 24 to the swing 14 and the bassinet 16 in greater detail. The swing output shaft 108 and the bassinet output shaft 110 outwardly extend in opposite directions from the gear assembly housing 106 and through an opening defined within the housing portion 112 and an opening defined within the swing side housing portion 113 of the drive assembly 24. When engaged with the gear assembly 118, the swing output shaft 108 pivots about the axis 42 causing the swing 14 to pivot or swing, and the bassinet output shaft 110 pivots about the axis 52 causing the bassinet 16 to pivot or rock. The output shafts 108, 110 are made of plastic. Alternative materials for the output shaft 108, 110 are contemplated, such as, for example, metals.

The output shaft 108, 110 includes an arm 116, 117, a keyed extension 130, 131 of the gear assembly 118 and an output shaft extension 132, 133. The arm 116, 117 outwardly extends from the shaft 108, 110 and is connected to a swing gear linkage 150 and a bassinet gear linkage 152, respectively. The arm 116, 117 transfers the motion of the swing gear linkage 150 and the bassinet gear linkage 152 to the output shaft 108, 110, respectively. The keyed extension 130, 131 outwardly extends through from the gear assembly 118 through the gear assembly housing 106 and includes a keyed end for engaging the shaft extension 132, 133, respectively. In a preferred embodiment, the keyed extension 130, 131 has a rectangular extension for engaging the shaft extension 132, 133.

In order to couple the output shaft 108, 110 to the swing 14 and the bassinet 16, respectively, the shaft extension 131, 132 is provided. The shaft extension 132 engages the keyed extension 130 within the drive assembly 24 and outwardly extends through the bassinet housing portion 112. The shaft extension 133 engages the keyed extension 131 within the drive assembly 24 and outwardly extends through the swing side housing portion 113. The shaft extension 132, 133 includes a limiter 134, 135 and a bearing 136, 137, respectively. The limiter 134, 135 is a projection radially extending from the axis 42 or the axis 52 of the output shaft 108, 110, respectively. The limiter 134, 135 is positioned between the gear assembly housing 106 and the housing of drive assembly 24. The limiter 134, 135 pivots between a pair of ridges (not shown) inwardly extending from the bassinet housing portion 112 and the swing side housing portion 113, respectively. In operation, the limiter 134, 135 pivots with the output shaft 108, 110, respectively, within a V-shaped region formed by the pair of ridges. The limiter 134, 135 alternately contacts each ridge, during operation, as the limiter 134, 135 pivots between the gear assembly housing 106 and the housing of the drive assembly 24. The contact of the limiter 134, 135 with each of the ridges further limits the pivotal movement of the limiter 134, 135, and also the swing 14 and the bassinet 16, respectively. The bearing 136 extends through the bassinet housing portion 112 and is configured to slidably engage a bassinet supporting bracket 140 outwardly extending from the bassinet 16. The bearing 137 extends through the swing housing portion 113 and is configured to slidably engage a swing supporting the bracket 142 outwardly extending from the swing 14. In a preferred embodiment, the bearing 136, 137 includes a squared shaft and the supporting bracket 140, 142 is U-shaped for slidably receiving the bearing 136, 137, respectively. The engagement of the bearing 136, 137 to support the brackets 140, 142 enables the pivotal motion of the output shaft 108, 110 to transfer to the bassinet 16 and the swing 14, respectively.

Figure 6:
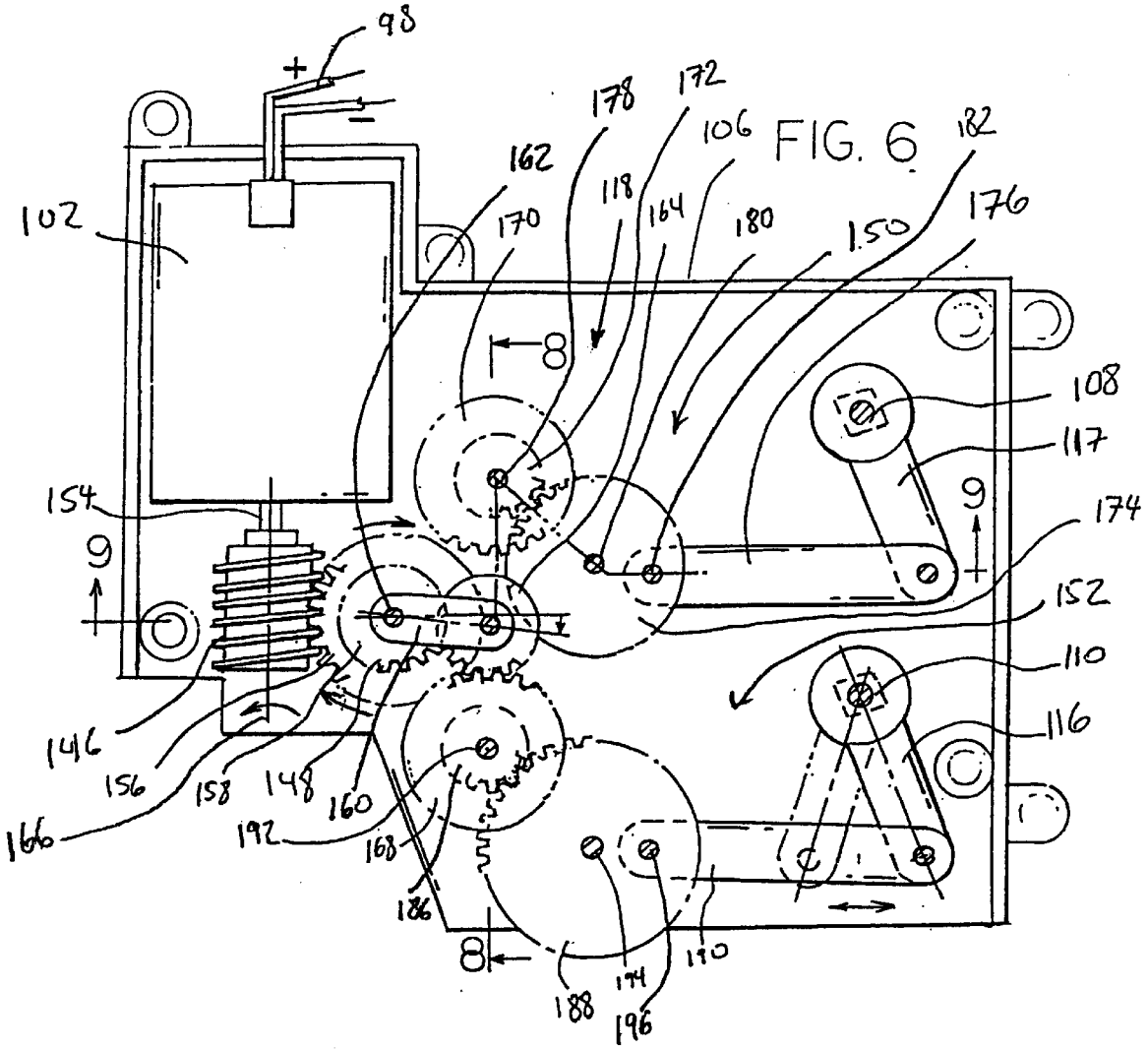
FIG. 6 is a cross-sectional view of the gear assembly of the drive assembly of FIG. 2 with a side wall of the gear assembly housing removed and showing operation of the bassinet of the doll nursery.
Figure 7:
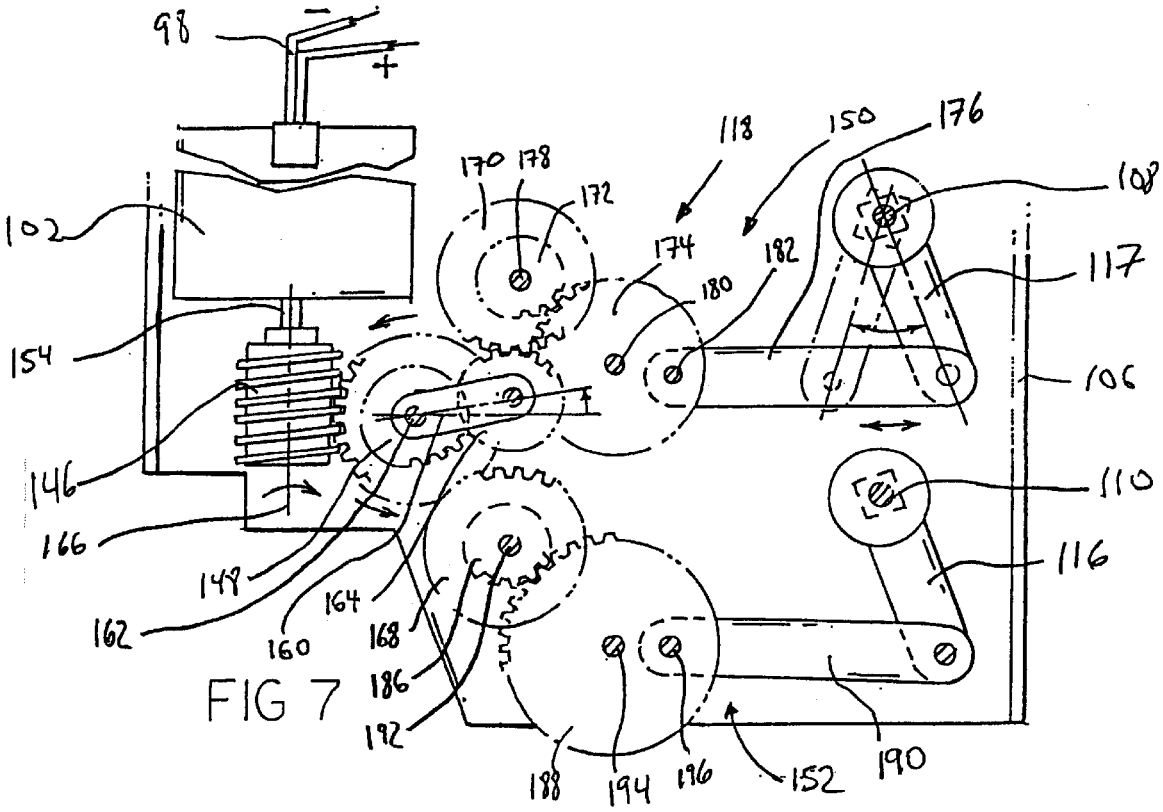
FIG. 7 is a cross-sectional view of the gear assembly of the drive assembly of FIG. 2 with a side wall of the gear assembly housing removed and showing operation of the swing of the doll nursery.
Figure 8:
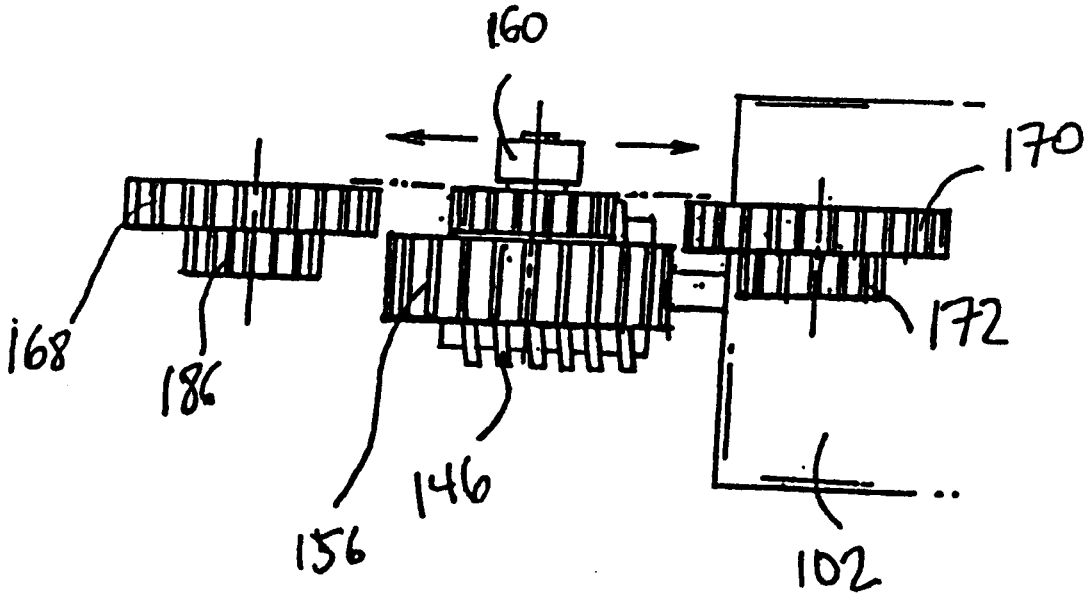
FIG. 8 is a sectional view of the gear assembly taken substantially along line 8—8 of FIG. 6.

FIGS. 6 through 8 illustrate the gear assembly 118 of the drive assembly 24 in greater detail. The gears, links and pins of the gear assembly 118 are preferrably made of plastic. Alternative materials for the gears, links and pins of the gear assembly 118 can be used, such as, for example, metal and wood. FIG. 6 illustrates the operation of the gear assembly 118 and the bassinet 16. FIG. 7 illustrates the operation of gear assembly 118 and the swing 14. The gear assembly 118 includes a worm gear 146, the pivoting gear linkage 148, the swing gear linkage 150 and the bassinet gear linkage 152. The worm gear 146 is mounted onto a motor output shaft 154 and transfers the rotational movement of an output shaft 154 of the motor 102 to the pivoting gear linkage 148. Alternative gearing and linkage arrangements are contemplated for transferring the rotational movement of the motor 102 to pivoting the gear linkage 148. Pivoting the gear linkage 148 includes first and the second gears 156, 158 concentrically mounted to one end of a first link 160 at a first pin 162 and a third gear 164 connected to an opposite end of the first link 160. The first gear 156 is larger than the second gear 158 and operably engages the worm gear 146. The second gear 158 rotates with the first gear 156 about the first pin 162, and the second gear 158 operably engages the third gear 164. The engagement and operation of the second and third gears 158, 164 enables the first link 160 to pivot with respect to the first pin 162 between the space defined between the swing gear linkage 150 and the bassinet gear linkage 152.

As shown in FIG. 6, in operation, when the motor 102 receives current is flow through the wire connection 98 under a first polarity, the output shaft 154 and the worm gear 146 rotate in a counter clockwise direction about a motor axis 166, when viewing the worm gear 146 from the distal end toward motor 102. The counter clockwise rotation of the worm gear 146 causes the first gear 156 to rotate in a clockwise direction about the first pin 162, and causes the first link 160 to pivot from the swing gear linkage 150 toward the bassinet gear linkage 152, until the third gear 164 engages a fourth gear 168 of the bassinet gear linkage 152. Conversely, as shown in FIG. 7, in operation, when the motor 102 receives current flow through the wire connection 98 under a second polarity, the drive train rotates in an opposite direction.

The clockwise rotation of the worm gear 146 causes the first gear 156 to rotate in a counter clockwise direction about the first pin 162, and causes the first link 160 to pivot from the bassinet gear linkage 152 toward the swing gear linkage 150, until the third gear 164 engages a fifth gear 170 of the swing gear linkage 150. The pivoting feature of pivoting the gear linkage 148 enables a single motor 102 to selectably operate the swing 14 and the bassinet 16, thereby reducing the equipment required for, and the manufacturing costs of, producing the nursery 10. The pivoting gear feature can be employed to selectably and efficiently operate any two pieces of equipment connected to the outputs of a gear assembly. FIG. 8 further illustrates the range of pivotal movement available to pivoting the gear linkage 148.

Referring to FIGS. 6 and 7, the swing gear linkage 150 includes the fifth, sixth and seventh gears 170, 172, 174 and the second link 176. The fifth and sixth gears 170, 172 are concentric gears, which are connected and mounted to the second pin 178. The fifth gear 170 operably engages the third gear 164. The fifth gear 170 has a larger diameter than the sixth gear 172. The sixth gear 172 operably engages the seventh gear 174. The seventh gear 174 rotates about the third pin 180 and includes an outwardly projection mount 182. The mount 182 outwardly projects in a direction parallel to the third pin 180 and is radially spaced on the seventh gear 174 from the third pin 180. A first end of second link 176 is connected to the mount 182 of the seventh gear 174. The second link 176 is an elongate member which connects at a second end to arm 117 of the swing output shaft 108. The swing gear linkage 150 transfers the rotational movement of the third gear 164 of pivoting the gear linkage 148 to swing the output shaft 108.

The bassinet gear linkage 152 includes the fourth, eighth and ninth gears 168, 186, 188 and the third link 190. The fourth and eighth 168, 186 are concentric gears, which are connected and mounted to the fourth pin 192. The fourth gear 168 operably engages the third gear 164. The fourth gear 168 has a larger diameter than the eighth gear 186. The eighth gear 186 operably engages the ninth gear 188. The ninth gear 188 rotates about the fifth pin 194 and includes an outwardly projection mount 196. The mount 196 of the ninth gear 188 outwardly projects in a direction parallel to the fifth pin 194 and is radially spaced on the ninth gear 188 from the fifth pin 194. A first end of the third link 190 is connected to the mount 196 of the ninth gear 188. The third link 190 is an elongate member which connects at a second end to the arm 116 of the bassinet output shaft 110. The swing gear linkage 150 transfers the rotational movement of the third gear 164 of pivoting the gear linkage 148 to the bassinet output shaft 110. In alternative exemplary embodiments, other gear and linkage arrangements can be used to produce varied outputs of the output shafts 108, 110, including variations in the speed of rotation of the output shafts 108, 110 and variations in the extent of rotation of the output shafts 108, 100.

Figure 9:
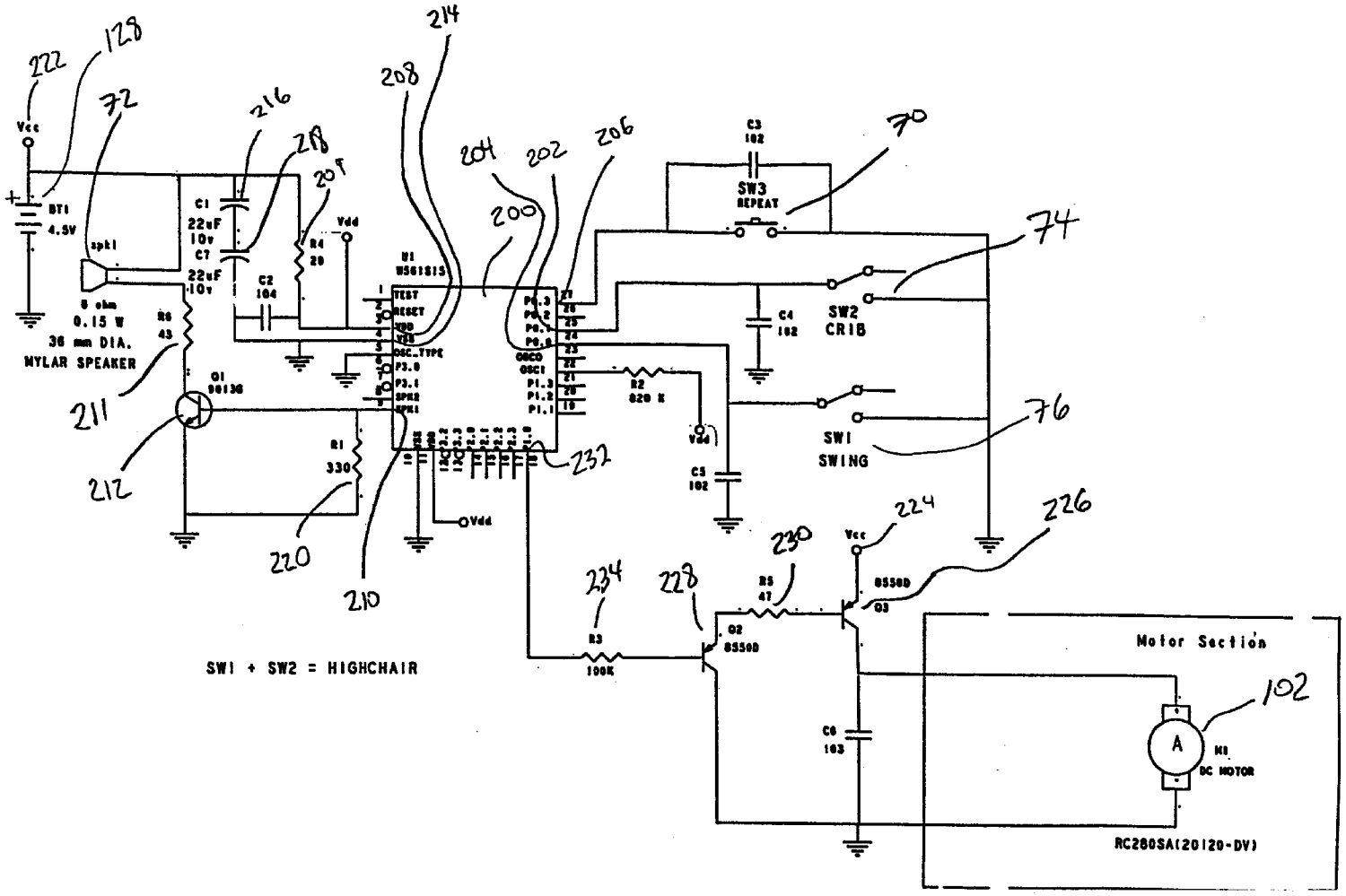
FIG. 9 is an electronic circuit diagram of the control system of the doll nursery in accordance with a preferred embodiment of the present invention.

Referring to FIG. 9, a preferred embodiment of a circuit diagram for the control of the actuation device 22 is illustrated. The PCB 82 includes a circuit comprising a microprocessor 200, or microcontroller, capable of synthesizing several different baby voices, baby-related sounds and music. An example of such a chip is the Winbond BandDirector™ microprocessor model number W561S15. Alternative microprocessors or microcontrollers can be used. The microcontroller 200 is actuated by the first and second switches 74, 76, and the pushbutton 70. The First and second switches 74, 76 and the pushbutton 70 are connected to the trigger inputs 202, 204, 206, respectively, such that when a switch or pushbutton triggers the associated trigger input, the microprocessor 200 generates and outputs a transducer controlling signal which corresponds to the switch, or combination of switches, chosen. The microprocessor 200 is powered by a power supply (batteries 128.) The collective positive end of the batteries 128 is connected to: a first voltage input 208 of the microprocessor 200 through a resistor 209; and a second voltage input 214 through the capacitors 216, 218. The positive end of the batteries 128 is connected to the sound transducer 72. The sound transducer 72 then connects to the collector of a first transistor 212 through a resistor 211. The base of the first transistor 212 is connected to a speaker connection 210. The emitter of the first transistor 212 is connected to ground and to a speaker connection 210 through a resistor 220. The positive end of the batteries 128 also connects to a first terminal point 222. The first terminal point 222 connects to a second terminal point 224. The terminal point 224 connects to a collector of a second transducer 226. The emitter of the second transducer 226 connects to the one terminal of motor 102. The base of the second transducer 226 connects to a collector of a third transducer 228 through the resistor 230. The emitter of the third transducer 226 is connected to ground and to the opposite terminal of the motor 102. The base of the third transducer 228 is connected to a motor input 232 through a resistor 234.

When the microprocessor 200 outputs a sound signal through the speaker connection 210, the sound signal is transmitted to the base of the transistor 212 enabling current to flow through the sound transducer 72. The sound signal from the speaker connection 210 of the microprocessor 200 controls the sound transducer 72 causing it to produce baby-like sounds or music. When the switch 74 is actuated, the microprocessor 200 sends a signal to the sound transducer 72 to produce the music and sounds associated with the bassinet 16. When the switch 76 is actuated, the microprocessor 200 sends a signal to the sound transducer 72 to produce the music and sounds associated with the swing 14. When the first and second switches 74, 76 are actuated, the microprocessor 200 sends a signal to the sound transducer 72 to produce the music and sounds associated with the seat member 18. When the pushbutton 70 is depressed in conjunction with one or both of the first and second switches 74, 76, the microprocessor 200 sends a signal to the sound transducer 72 to produce the music or sounds associated with the bassinet 16, the swing 14 or the seat member 18, depending upon the location of the actuation device 22. The microprocessor 200 includes a timer for controlling the length of sound segments of music, baby sounds, baby-related sounds and other desirable sound patterns and for controlling the length of operation of the bassinet 16 or the swing 14 following actuation.

The control system logic dictates the sounds and music produced by the sound transducer 72 as a result of the signal from the microprocessor 200 in response to the actuation of the first and second switches 74, 76 and the pushbutton 70. In a preferred embodiment, the microprocessor 200 can produce a signal to play six different songs and produce twelve different baby or baby-related sounds. In alternative exemplary embodiments, different types of sounds, different types of music and different total numbers of these sounds and music for different durations can be used.

Figure 10:
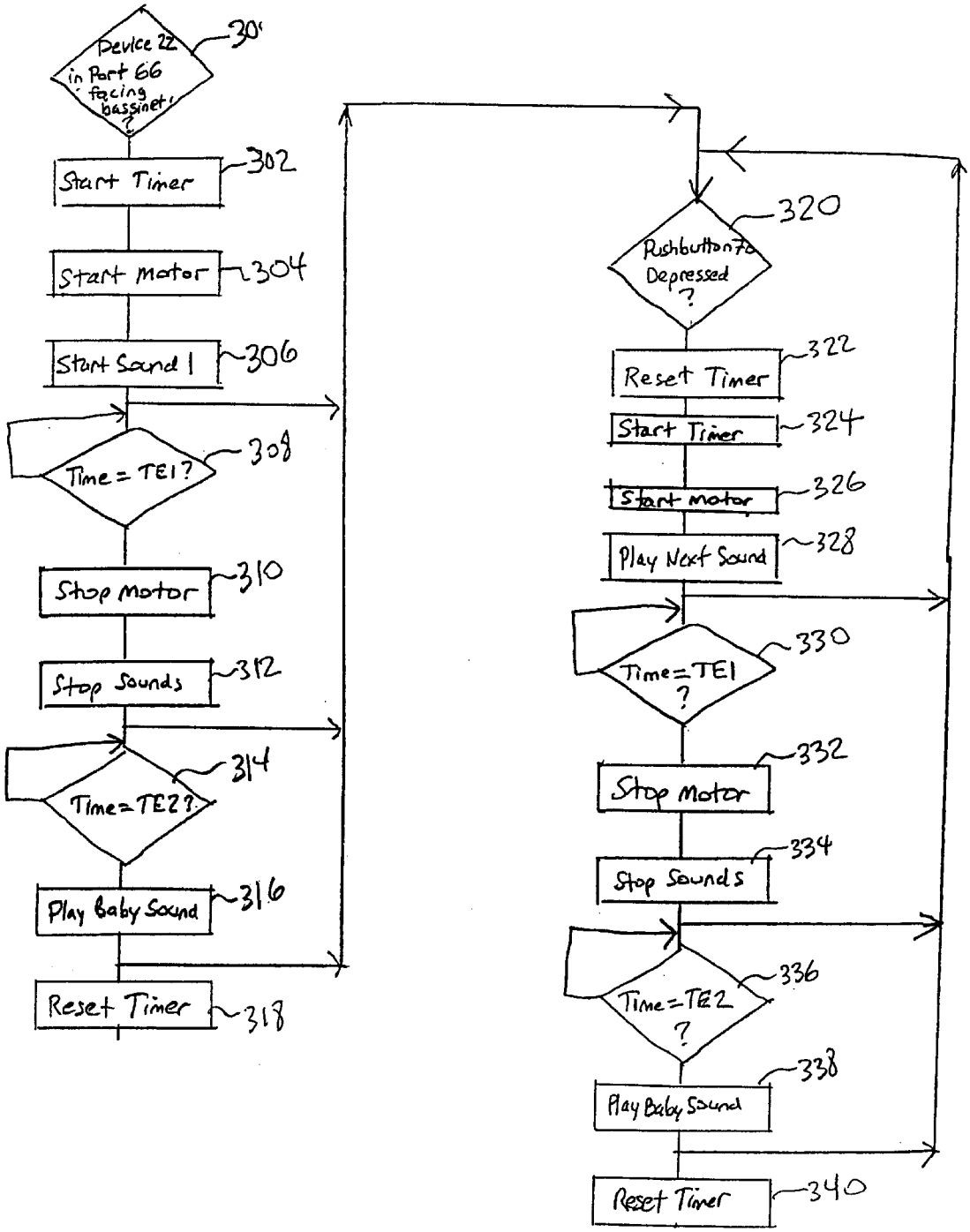
FIG. 10 is a flowchart showing the activity of the doll nursery control system during operation of the bassinet.

Referring to FIG. 10, one exemplary embodiment of the control system logic for the bassinet 16 of the microprocessor 200 is illustrated. Other logic sequences are available and would be known to a person of ordinary skill in the art. The actuation device 22 is connected to the drive assembly 24 at the receiving port 66 with the actuation device 22 facing the bassinet 16, shown at 300. Internal timer within the microprocessor 200 is activated, shown at 302. The motor 102 control circuit to start motor is closed and the motor 102 starts, shown at 304. The first bassinet sound sequence ("Bizahm's Lullaby" and baby noises) is initiated, shown at 306. The microprocessor 200 then determines if time is equal to a first timer event, shown at 308. If time is not equal to the first timer event, or if the pushbutton 70 is not depressed, no changes will occur. In a preferred embodiment, the first timer event is approximately 20 seconds. When time equals the first timer event, the microprocessor 200 stops the motor 102, shown at 310, and stops the first sound sequence, shown at 312. The microprocessor 200 then determines if time is equal to a second timer event, shown at 314. If time is not equal to the second timer event, or if the pushbutton 70 is not depressed, no changes will occur. In a preferred embodiment, the second timer event is approximately 10 seconds. When time equals the second timer event, the microprocessor 200 plays a baby sound or baby-related sound randomly selected from the twelve such sounds stored within the microprocessor 200, shown at 316. If the pushbutton 70 is not depressed, the microprocessor 200 resets internal timer, shown at 318 and no additional activity occurs.

At anytime between the starting of internal timer, the motor 102 and the first sound sequence, shown at 302, 304, 306 until the actuation device 22 is removed from the receiving port 66, if the pushbutton 70 is depressed, additional activity occurs, indicated at 320. If the pushbutton 70 is depressed, the microprocessor 200 resets the internal timer, or verifies that the internal timer is reset, shown at 322. The microprocessor 200 starts the internal timer, indicated at 324. The microprocessor 200 starts the motor 102, indicated at 326. The microprocessor 200 plays the second bassinet sound sequence ("Twinkle, Twinkle Little Star" and baby related sound) or, plays the next sound sequence of the three bassinet sound sequences, indicated at 328. The third bassinet sound sequence is "Rock-a-bye Baby" and baby related sounds. The microprocessor 200 then determines if time is equal to a first timer event, indicated at 330. If time is not equal to the first timer event, or if the pushbutton 70 is not depressed, no changes will occur. When time equals the first timer event, the microprocessor 200 stops the motor 102, indicated at 332, and stops the first sound is sequence, shown at 334. The microprocessor 200 then determines if time is equal to a second timer event, indicated at 336. If time is not equal to the second timer event, or if the pushbutton 70 is not depressed, no changes will occur. When time equals the second timer event, the microprocessor 200 plays a baby sound or baby-related sound randomly selected from the twelve such sounds stored within the microprocessor 200, indicated at 338. If the pushbutton 70 is not depressed, the microprocessor 200 resets internal timer and no additional activity occurs, indicated at 340. If at anytime between the starting of internal timer, the motor 102 and the first sound sequence, indicated at 324, 326, 328, or until the actuation device 22 is removed from the receiving port 66, if the pushbutton 70 is depressed, the logic returns to item 320 and repeats.

Figure 11:
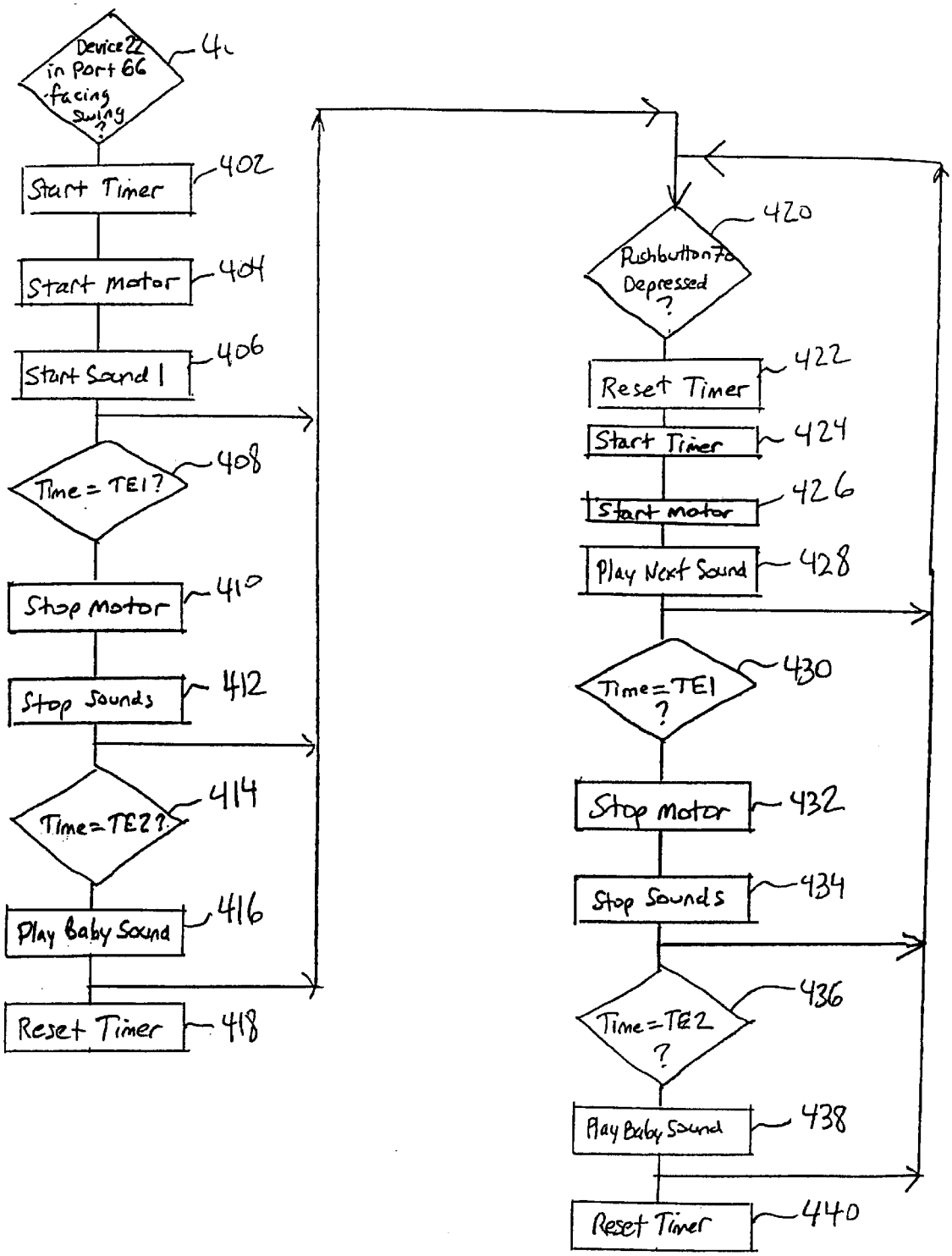
FIG. 11 is a flowchart showing the activity of the doll nursery control system during operation of the swing.

Referring to FIG. 11, one exemplary embodiment of the control system logic for the swing 14 of the microprocessor 200 is illustrated. Other logic sequences are available and would be known to a person of ordinary skill in the art. The actuation device 22 is connected to the drive assembly 24 at the receiving port 66 with the actuation device 22 facing the swing 14, indicated at 400. Internal timer within the microprocessor 200 is activated, indicated at 402. The motor 102 control circuit to start motor is closed and the motor 102 starts, indicated at 404. The first swing sound sequence (for example, "Pop Goes the Weasel" and baby noises) is initiated, indicated at 406. The microprocessor 200 then determines if time is equal to a first timer event, indicated at 408. If time is not equal to the first timer event, or if the pushbutton 70 is not depressed, no changes will occur. In a preferred embodiment, the first timer event is approximately 20 seconds. When time equals the first timer event, the microprocessor 200 stops the motor 102, indicated at 410, and stops the first sound sequence, indicated at 412. The Microprocessor 200 then determines if time is equal to a second timer event, indicated at 414. If time is not equal to the second timer event, or if the pushbutton 70 is not depressed, no changes will occur. In a preferred embodiment, the second timer event is approximately 10 seconds. When time equals the second timer event, the microprocessor 200 plays a baby sound or baby-related sound randomly selected from the twelve such sounds stored within the microprocessor 200, indicated at 416. If the pushbutton 70 is not depressed, the microprocessor 200 resets internal timer, indicated at 418 and no additional activity occurs.

At anytime between the starting of internal timer, the motor 102 and the first sound sequence, indicated at 402, 404, 406 until the actuation device 22 is removed from the receiving port 66, if the pushbutton 70 is depressed, additional activity occurs, indicated at 420. If the pushbutton 70 is depressed, the microprocessor 200 resets the internal timer, or verifies that the internal timer is reset, indicated at 422. The microprocessor 200 starts the internal timer, shown at 424. The microprocessor 200 starts the motor 102, indicated at 426. The microprocessor 200 plays the second swing sound sequence ("baby related sounds") or, plays the next sound sequence of the three swing sound sequences, indicated at 428. The third swing sound sequence is "Row, Row, Row Your Boat" and baby related sounds. The microprocessor 200 then determines if time is equal to a first timer event, indicated at 430. If time is not equal to the first timer event, or if the pushbutton 70 is not depressed, no changes will occur. When time equals the first timer event, the microprocessor 200 stops the motor 102, shown at 432, and stops the first sound sequence, indicated at 434. The microprocessor 200 then determines if time is equal to a second timer event, indicated at 436. If time is not equal to the second timer event, or if the pushbutton 70 is not depressed, no changes will occur. When time equals the second timer event, the microprocessor 200 plays a baby sound or baby-related sound randomly selected from the twelve such sounds stored within the microprocessor 200, indicated at 438. If the pushbutton 70 is not depressed, the microprocessor 200 resets internal timer and no additional activity occurs, indicated at 440. If at anytime between the starting of internal timer, the motor 102 and the first sound sequence, indicated at 424, 426, 428, or until the actuation device 22 is removed from the receiving port 66, if the pushbutton 70 is depressed, the logic returns to the item 420 and repeats.

Figure 12:
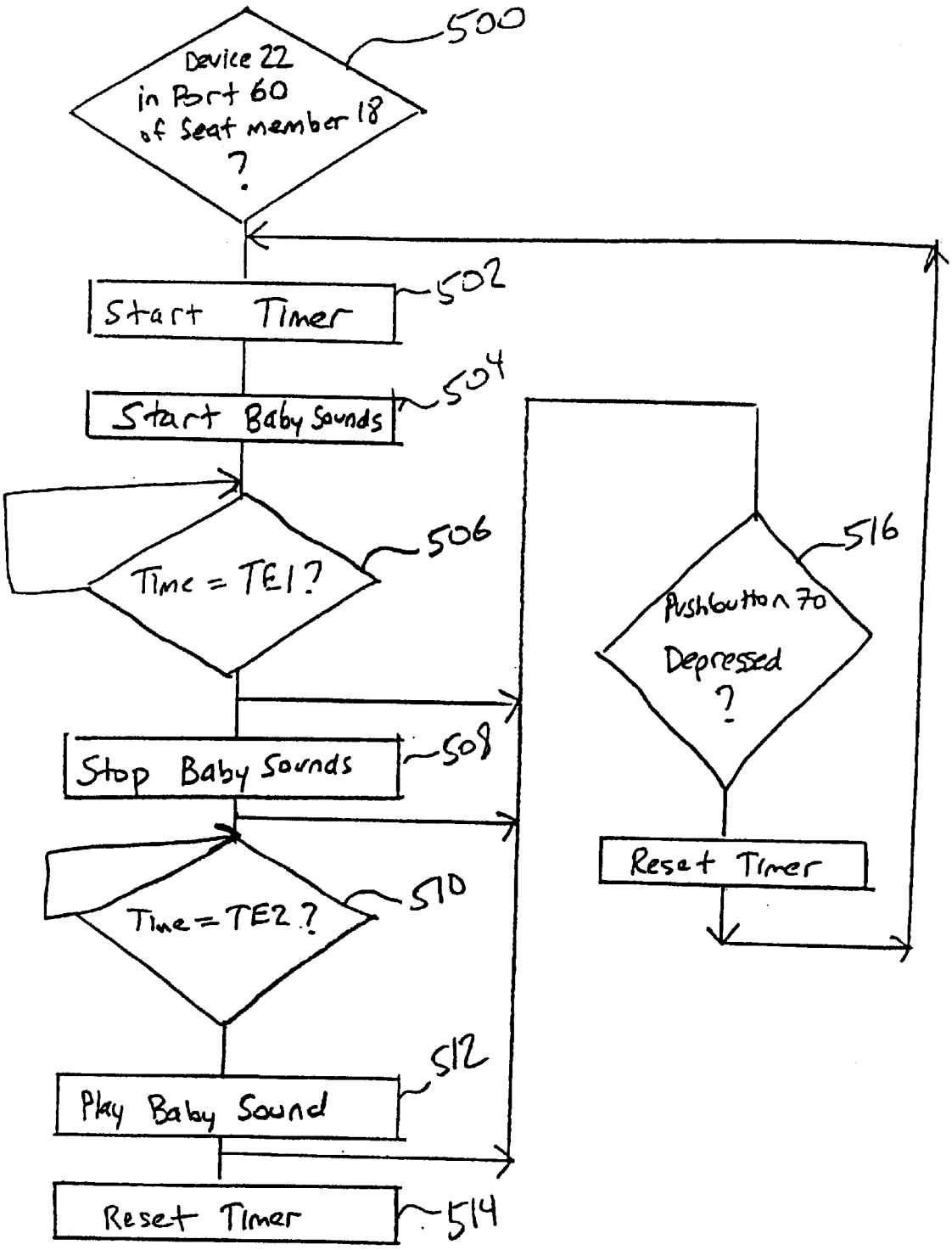
FIG. 12 is a flowchart showing the activity of the doll nursery control system during operation of the high chair or seat member.

Referring to FIG. 12, one exemplary embodiment of the control system logic of the microprocessor 200 is for the high chair, or the seat member 18, illustrated. Other logic sequences are available and would be known to a person of ordinary skill in the art. The actuation device 22 is connected to seat member 18 at the receiving port 60 with the actuation device 22, shown at 500. The internal timer within the microprocessor 200 is activated, shown at 502. A high chair sound sequence (baby-related sounds) is initiated, shown at 504. The microprocessor 200 then determines if time is equal to a first timer event, shown at 506. If time is not equal to the first timer event, or if the pushbutton 70 is not depressed, no changes will occur. In a preferred embodiment, the first timer event is approximately 20 seconds. When time equals the first timer event, the microprocessor 200 stops the high chair sound sequence, shown at 508. The microprocessor 200 then determines if time is equal to a second timer event, shown at 510. If time is not equal to the second timer event, or if the pushbutton 70 is not depressed, no changes will occur. In a preferred embodiment, the second timer event is approximately 10 seconds. When time equals the second timer event, the microprocessor 200 plays a baby sound or baby-related sound randomly selected from the twelve such sounds stored within the microprocessor 200, shown at 512. If the pushbutton 70 is not depressed, the microprocessor 200 resets internal timer, shown at 514 and no additional activity occurs. At anytime between the starting of the internal timer and the high chair sound sequence, shown at 502, 504 until the actuation device 22 is removed from the receiving port 60, if the pushbutton 70 is depressed, additional activity occurs, shown at 516. If the pushbutton 70 is depressed, the microprocessor 200 resets the internal timer, or verifies that the internal timer is reset, shown at 516 and re-initiates the high chair logic sequence beginning at step designated as 502.

While a preferred embodiment of the present invention has been described and illustrated, numerous departures therefrom can be contemplated by persons skilled in the art, for example, the nursery 10 can be adapted to accommodate infants and small children. According to another exemplary embodiment, the drive assembly 24 can be used to control two separate toys, tools, or devices using a single motor. According to another exemplary embodiment, the actuation device 22 can be a remote control device used to remotely operate the swing, the highchair sounds and the bassinet of the nursery 10. Therefore, the present invention is not limited to the foregoing description but only to the scope and spirit of the appended claims.

What is claimed is:

1. A nursery comprising:

a frame;

a bassinet supported by the frame;

a swing supported by the frame;

a single drive unit having a drive unit output, the drive unit connected to the frame; and a coupling assembly operably coupled to the drive unit, and having first and second outputs, the first output pivotally coupled to the bassinet, the second output pivotally coupled to the swing, the coupling assembly configured to transfer the drive unit output to one of the swing and the bassinet such that the one of the swing and the bassinet swing relative to the frame.

2. The nursery of claim 1, wherein the nursery is a toy doll nursery.

3. The nursery of claim 1, wherein the frame includes a main support member and wherein the bassinet and the swing are supported at opposite sides of the main support member.

4. The nursery of claim 1, wherein the swing pivots about a first generally horizontal axis, wherein the bassinet pivots about a second generally horizontal axis, and wherein the first and second axes are substantially parallel to one another.

5. The nursery of claim 1, wherein the drive unit is a dc motor.

6. The nursery of claim 1, wherein the coupling assembly is a gear and linkage assembly.

7. The nursery of claim 5, wherein rotation of the motor in a first direction activates the first output of the coupling assembly and rotation of the motor in a second direction, opposite the first direction, activates the second output of the coupling assembly.

8. The nursery of claim 1, wherein the frame has a port and further comprising a relocatable transmitter actuation device configured to removably connect to the frame at the port in at least one position.

9. The nursery of claim 8, wherein the actuation device resembles a conventional baby monitor.

10. The nursery of claim 8, wherein the actuation device is selectably and removably connectable to the port of the frame in one of a first position, in which the actuation device activates the swing, and a second position, in which the actuation device activates the bassinet.

11. The nursery of claim 1, further comprising a seat member connected to the frame to form a high chair.

12. The nursery of claim 8, further comprising a sound transducer disposed within the actuation device, the sound transducer configured to produce sounds, a plurality of switches disposed within the actuation device, and a circuit connected to one of the actuation device and the frame, the circuit electrically coupled to the sound transducer and to the plurality of switches, the circuit configured to operate in response to the position of the plurality of switches and to generate a plurality of signals for controlling the sound transducer, the swing and the bassinet.

13. The nursery of claim 12, wherein the circuit generates separate signals to the sound transducer based upon different the positioning of the plurality of switches.

14. The apparatus of claim 1 further comprising a supply bin connected to the frame and disposed substantially beneath the bassinet.

15. An apparatus for selectably operating at least two separate features of a toy, the apparatus comprising:

a frame;

first and second devices coupled to the frame;

a control device;

a single drive unit coupled to the frame and operably coupled to the control device, the drive unit having a drive shaft configured to produce a first output movement and a second output movement in response to first and second control signals, respectively, from the control device; and a gear assembly coupled to the frame, the gear assembly including a pivoting member, and first and second output assemblies, the pivoting member operably coupled at a first end to the drive shaft, the pivoting member positionable between a first position, in which a second end of the pivoting member operably connects to the first output assembly in response to the first output movement of the drive shaft, and a second position, in which the second end of the pivoting member operably connects to the second output assembly in response to the second output movement of the drive shaft, the first and second output assemblies operably coupled to the first and second devices, respectively.

16. The apparatus of claim 14, wherein the first device is a swing and the second device is a bassinet.

17. The apparatus of claim 14, wherein the control device is a relocatable transmitter actuation device configured to removably connect to the frame in at least two positions.

18. An electronic play center comprising:

a frame having at least one actuator receiving port;

first and second movable devices supported by the frame;

a drive mechanism coupled to the frame and to the first and second movable devices;

a relocatable transmitter actuation device removably connected to the frame, the actuation device including a sound transducer, a circuit and a plurality of switches, the sound transducer connected to the actuation device and configured to produce sounds, a plurality of switches coupled to the actuation device, a circuit connected to the actuation device, the circuit electrically coupled to the sound transducer and to the plurality of switches, the circuit configured to operate in response to the position of the plurality of switches and to generate a plurality of signals for controlling the sound transducer and at least one of the first and second movable devices.

19. The electronic play center of claim 18 wherein the actuation device is removably mounted to the port of the frame in a first position, in which the actuation device produces a first set of sounds through the sound transducer and the actuation device activates the first movable device.

20. The electronic play center of claim 19 wherein the actuation device is removably mounted to the port of the frame in a second position, in which the actuation device produces a second set of sounds through the sound transducer and the actuation device activates the second movable device.

21. The electronic play center of claim 18, further comprising a doll high chair member connected to the frame, the high chair member including a high chair receiving port configured to removably receive the actuation device.

22. The electronic play center of claim 21, wherein the actuation device produces a third set of sounds when removably connected to the high chair receiving port of the high chair member.

23. The electronic play center of claim 18, wherein the first movable device is a swing and the second movable device is a bassinet.

24. The electronic play center of claim 18, wherein the actuation device and the first and second movable devices are battery operated and the actuation device is configured to hold at least one battery for operating the actuation device and the first and second movable devices.

25. The electronic play center of claim 18, wherein the actuation device resembles a conventional baby monitor.

26. The electronic play center of claim 18, wherein the drive assembly includes a dc motor and a gear train for selectably operating the first and second movable devices one at a time.

* * * * *